US011514765B2

(12) United States Patent
Blaser

(10) Patent No.: US 11,514,765 B2
(45) Date of Patent: Nov. 29, 2022

(54) SYSTEMS AND METHODS FOR SPATIAL SENSING AND TRACKING OF OBJECTS IN A SPACE

(71) Applicant: Mobile Tech, Inc., Hillsboro, OR (US)

(72) Inventor: Robert Logan Blaser, Farmington, UT (US)

(73) Assignee: Mobile Tech, Inc., Hillsboro, OR (US)

( * ) Notice: Subject to any disclaimer, the term of this patent is extended or adjusted under 35 U.S.C. 154(b) by 50 days.

(21) Appl. No.: 17/095,223

(22) Filed: Nov. 11, 2020

(65) Prior Publication Data

US 2021/0142632 A1 May 13, 2021

Related U.S. Application Data

(60) Provisional application No. 62/933,861, filed on Nov. 11, 2019.

(51) Int. Cl.
*G08B 13/14* (2006.01)
*G08B 13/24* (2006.01)

(52) U.S. Cl.
CPC ..... *G08B 13/1427* (2013.01); *G08B 13/2485* (2013.01); *G08B 13/1436* (2013.01)

(58) Field of Classification Search
CPC ..... G08B 13/1427; G08B 13/1436; G08B 13/2485
See application file for complete search history.

(56) References Cited

U.S. PATENT DOCUMENTS 5,245,317 A * 9/1993 Chidley ..... G08B 21/0288 367/93
2015/0194030 A1* 7/2015 Davidson ..... G08B 13/248 340/572.7
2016/0049069 A1* 2/2016 Oliveira ..... G08B 13/1427 340/539.11
2017/0301205 A1* 10/2017 Blaser ..... G06F 21/31
2019/0073887 A1* 3/2019 Nagata ..... G08B 21/0294

* cited by examiner

*Primary Examiner* — Andrew W Bee

(57) ABSTRACT

This disclosure is directed to product displays systems. In one aspect, a product display system includes three or more bases spatially distributed in a space. Each base has a wireless transceiver. The system includes a product display assembly comprising a puck assembly and a base assembly. The puck assembly has a surface on which a product is mountable for merchandising of the product to a customer and is untethered to the base assembly. The puck assembly executes machine-readable instructions that determines a coordinate location of the puck assembly within the space based on wireless communications between the puck assembly and the three or more bases. The puck assembly may also generate an alarm sound when the coordinate location is located within an alarm zone or a warning zone of the space.

21 Claims, 17 Drawing Sheets

SYSTEMS AND METHODS FOR SPATIAL SENSING AND TRACKING OF OBJECTS IN A SPACE

CROSS-REFERENCE TO RELATED APPLICATION

This application claims the benefit of Provisional Application No. 62/933,861, filed Nov. 11, 2019.

TECHNICAL FIELD

The present disclosure is directed to spatial sensing of objects, and in particular, to spatial tracking spatial locations of products in a retail space.

BACKGROUND

Selling products in a retail setting is often a balance between a seller's desire to create customer interest in products on display by allowing customers to inspect and handle the products and the seller's need to ensure that the products are not stolen. Retail sales of small electronic devices, such as cell phones, tablets, cameras, and wearable electronics, are often placed on display tables in large open retail settings, enabling customers an opportunity to inspect many different device models by simply walking from table to table. However, because many products on display can be easily concealed and stolen in a crowded open retail setting, products are secured using retractable tether assemblies. Each retractable tether assembly is attached to a display table and has a tether that is connected at one end to a product and at the other end to a self-winding reel located within the retractable tether assembly. When a customer lifts a product to examine the product features, the product is often held under very high tension by a retractable tether assembly, making it difficult for the customer to appreciate how the product actually feels. For example, customers often find tethered electronic devices cumbersome to inspect because of the high tension created by the retractable tether assemblies. As a result, retail sellers seek systems and methods for displaying products in a retail setting that enables customers more freedom to inspect products but without compromising security.

SUMMARY

This disclosure is directed to product displays systems in which the spatial locations of untethered products are tracked in a space. In one aspect, a product display system includes three or more bases spatially distributed in the space. Each base has a wireless transceiver. The system includes a product display assembly comprising a puck assembly and a base assembly. The puck assembly has a surface on which a product is mountable for merchandising of the product to a customer and is untethered to the base assembly. The puck assembly executes machine-readable instructions that determines a coordinate location of the puck assembly within the space based on wireless communications between the puck assembly and the three or more bases. The puck assembly may also generate an alarm sound when the coordinate location is located within an alarm zone or a warning zone of the space.

DETAILED DESCRIPTION

Figure 1:
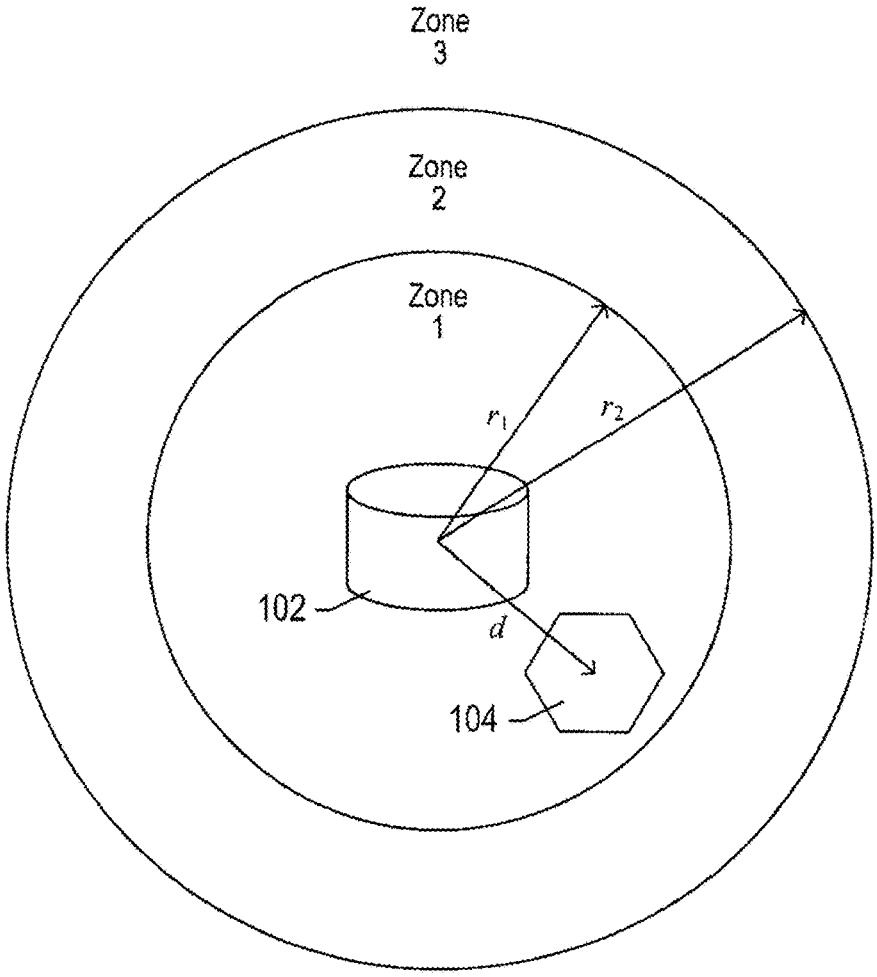
FIG. 1 shows an example of a base, an object, and an example of three different spatial zones centered on the base.

FIG. 1 shows an example of a base 102, an object 104, and an example of three different spatial zones centered on the base. The zones are centered on the base 102 are spherical but are shown in FIG. 1, and in subsequent figures, in planar cross-section. A first zone is a sphere with a radius denoted by $r_1$ and is identified as a "Zone 1." A second zone is a spherical shell with a radius between $r_1$ and a radius $r_2$ and is identified as a "Zone 2." A third zone comprises the space outside of the second zone and is identified as an "Zone 3." Whether the object 104 is located in one of the three zones is determined by a radial distance, d, between the object 104 and the base 102. If the distance $d \leq r_1$, the object 104 is located within the Zone 1. If the distance $r_1 < d < r_2$, the object 104 is located within the Zone 2. If the distance $d \geq r_2$, the object is located in the Zone 3. The object 104 may be attached to an item or product, such an electronic device, in a retail setting or the object 104 may be a wearable electronic device attached to a person. For example, the object 104 may be attached to a person's ankle or wrist. Methods described below determine how far the object 104 is from the base 102 and which zone the item, product or person is in. For example, the outer radius $r_1$ of Zone 1 may be be about 6 feet. For example, the outer radius of Zone 2 may be be about 12 feet. In this example, Zone 2 is a warning zone, while Zone 3 is an alarm zone.

Figure 2:
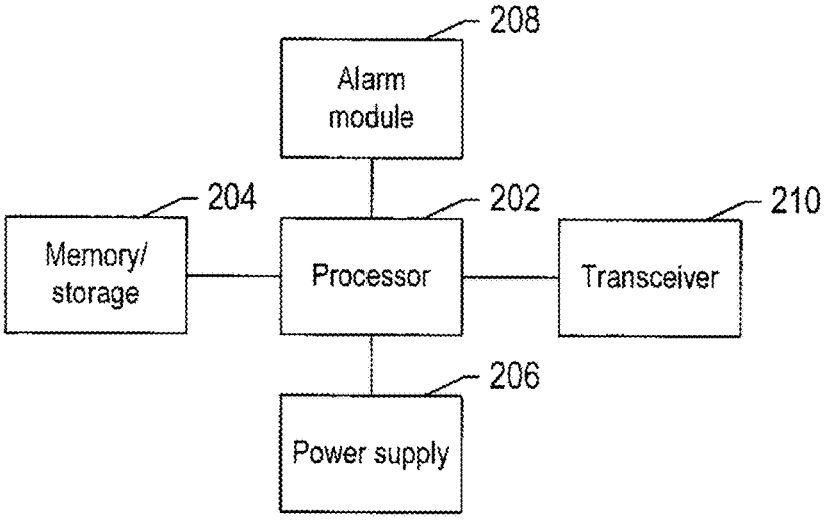
FIG. 2 shows an example of components for a base and an object.

In order to perform spatial tracking between the base 102 and the object 104, the base 102 and the object 104 are equipped with transceivers, memory, and processing equipment that are used for wireless communication between the base 102 and the object 104. FIG. 2 shows an example of components for the base 102 and the object 104. The components include a processor 202, memory/storage 204, a power supply 206, an alarm module 208, and a wireless transceiver 210. In the case of the object 104, the power supply 206 may be a rechargeable battery while the base 102 may be connected to an electrical outlet. In another implementation, the alarm model 208 may be located in the base 102 and/or the object 104. The wireless transceivers located in the object 104 and the base 102 enable the two devices to wirelessly communicate with each other by sending and receiving wireless signals. The memory/data storage 204 is a computer-readable medium that stores machine-readable instructions that enable the processors located in the respective object 104 and base 102 to execute machine-readable instructions that employ any of a number of different techniques for determining the distance d between the base 102 and the object 104 and activating the alarm based on the distance d. The techniques for determining the distance d may be based on signal strength, radio frequency ("RF") angle of arrival and departure, ultrasonic time of flight ("TOF"), RF TOF, and ultra-wide band TOF.

Because signal strength decreases with distance from the source of the signal, the relationship between signal strength and distance can be used to determine the distance between the base 102 and the object 104. For example, the base 102 may emit a pulse or ping that is received by the object 104. The object 104 may use the strength of the signal to determine the distance from the object 104 to the base 102. Alternatively, the object 104 may emit a pulse or a ping that is received by the base 102. The base 102 may use the strength of the signal to determine the distance from the object 104 to the base 102.

Figure 3:
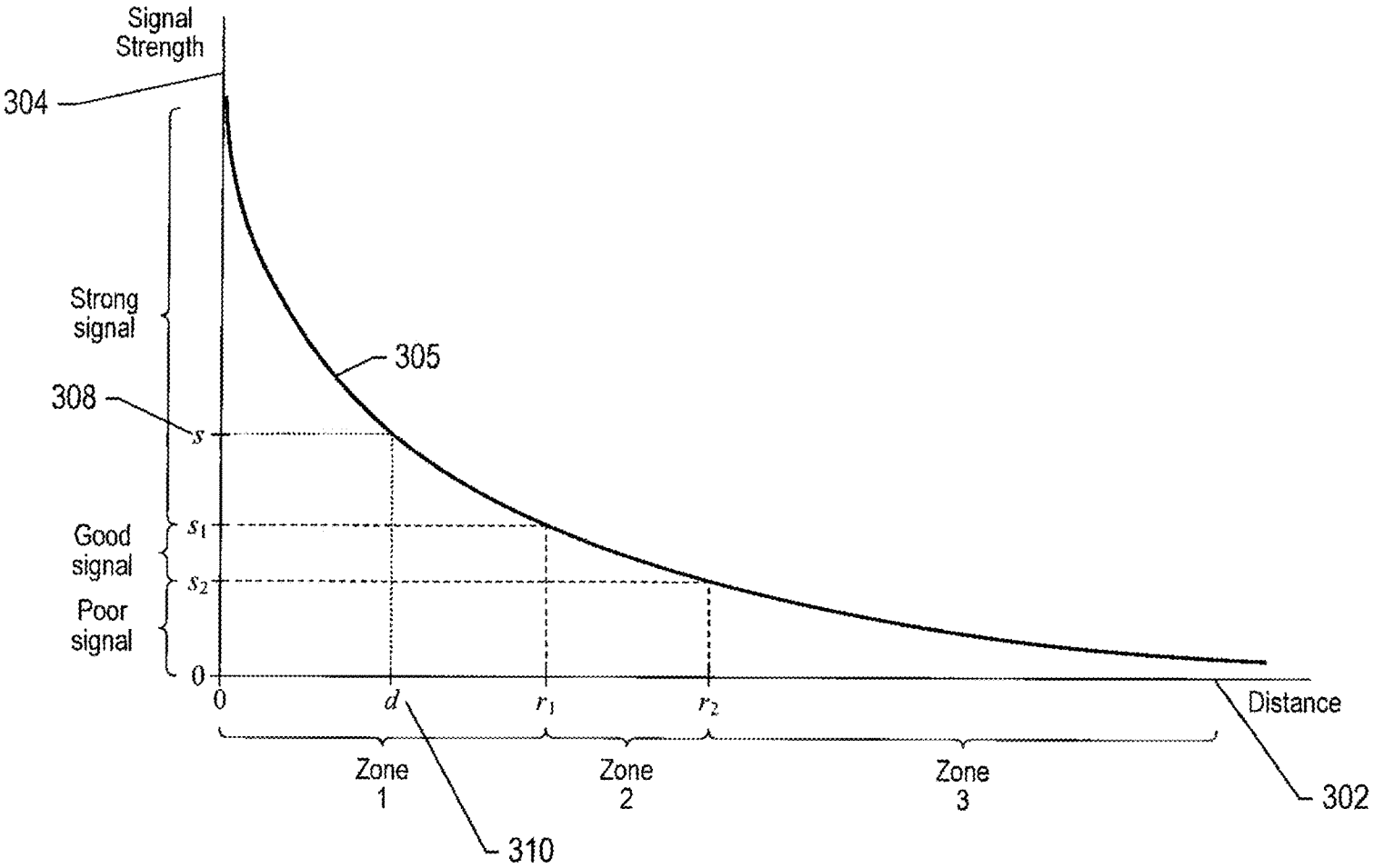
FIG. 3 shows an example plot of signal strength versus distance.

FIG. 3 shows an example plot of signal strength versus distance. Horizontal axis 302 represents distance. Vertical axis 304 represents signal strength. Curve 306 represents signal strength as a function of distance. For example, a signal strength s 308 detected at the object 104, or at the base 102, corresponds to a separation distance d between the base 102 and the object 104. The signal strength can be used to determine which zone the object 104 is located in. For example, threshold signals $s_1$ and $s_2$ located along signal strength axis 304 separate strong, good, and poor signal ranges that correspond to Zones 1, 2, and 3 separated by the radii $r_1$ and $r_2$ along the distance axis 302. The object 104 can use the signal strength to determine which of the three zones the object is located in. For example, if the object 104 detects a ping from the base 102 with the signal strength s 308, the object 104 determines that the object 104 is located in Zone 1. Alternatively, if the base 102 receives a ping from the object 104 with the signal strength s 308, the base 102 determines that the object 104 is located in Zone 1.

In another implementation, the base 102 and the object 104 can use TOF of transmitted and returned ultrasonic signals or RF signals to determine the distance between the base 102 and the object 104. For example, the signals sent between the base 102 and the object 104 may be ultra-wide band radio frequency signals. Let $t_1$ denote the time when the base 102 (object 104) emits a first signal that is received by the object 104 (base 102) which responds with a second signal received by the base 102 object 104) at later time $t_2$. Let $t=t_2-t_1$ be the roundtrip time for the transmitted and returned signals. The distance between the base 102 and the object 104 is $d=c\times t/2$, where c is the speed of light.

Figure 4:
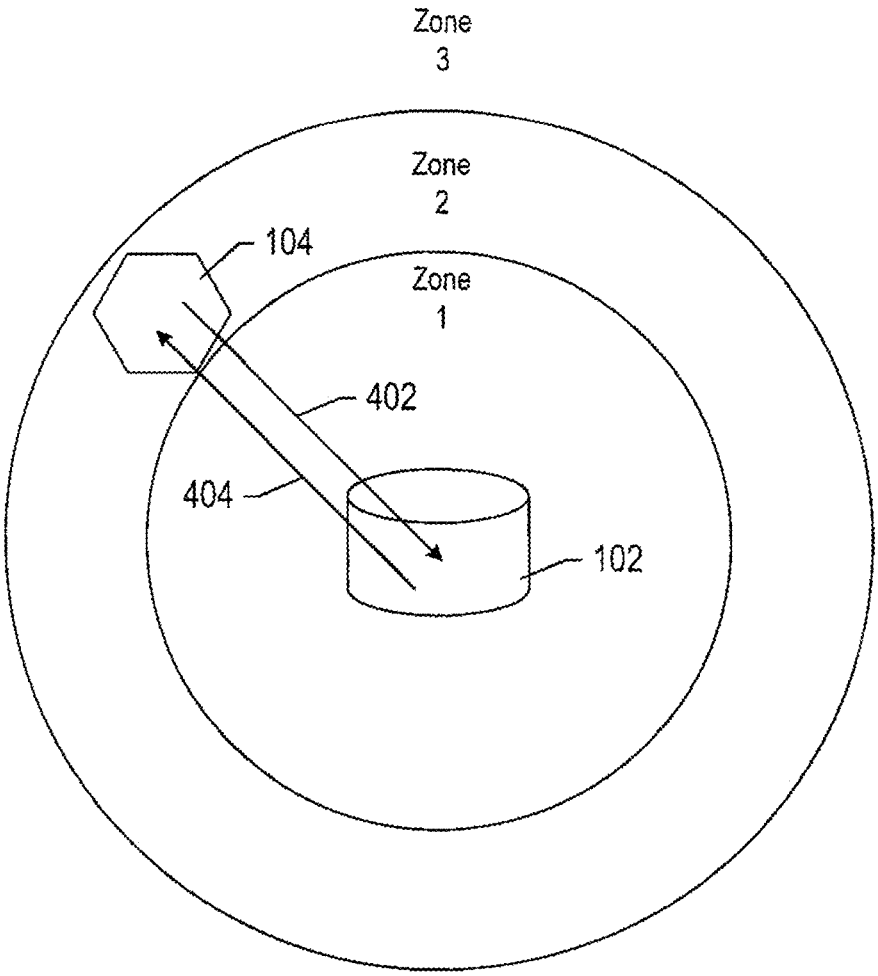
FIG. 4 shows an example of how an object can be spatially tracked with respect to the location of a base.

FIG. 4 shows an example of how the object 104 can be spatially tracked where a wireless transceiver in the object 104 communicates with a wireless transceiver located in the base 102. Directional arrow 402 represents a wireless transmission of a signal from the object 104 to the base 102. Directional arrow 404 represents a wireless transmission of a signal from the base 102 sent in response to the signal received from the object 104. At any given cadence, the object 104 can initiate a signal transmission which the base 102 will receive and send a response signal. The wireless transceiver in the base 102 can be in receive/respond mode at all times so that it can receive any signal transmission sent to it by the wireless transceiver of the object 102. When the wireless transceiver of the object 104 receives the response signal from the wireless transceiver of the base 102, the processor of the object 104 calculates the distance d between the object 104 and the base 102 based on the roundtrip time t as described above.

Figure 5:
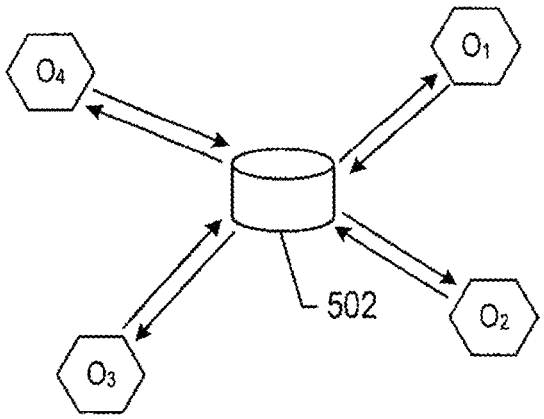
FIG. 5 shows an example of a base and four example objects.

In other implementations, signals transmitted between a base and two or more objects may be sent and received using packets that include source and destination addresses so that the base can communicate separately with each of the two or more objects. FIG. 5 shows an example of a base 502 and four example objects denoted by $O_1$, $O_2$, $O_3$, and $O_4$. Each object sends an object packet encoded in a signal that includes the address of the object as the source address and the address of the base 502 as the destination address. In response to receiving the object packet, the base 502 emits a base packet encoded in a signal that includes the address of the base 502 as the source address of the address of the object as the destination address. Because the base packet encodes only the destination address of the source object, the other objects ignore the base packet. For example, suppose the object $O_1$ generates an object packet encoded in a signal that includes the address of the object $O_1$ as the source address and the address of the base 502 as the destination address. In response to receiving the object packet, the base 502 emits a packet encoded in a signal that includes the address of the base 502 as the source address of the object $O_1$ as the destination address. Because the base packet encodes only the destination address of the object $O_1$, the other objects $O_2$, $O_3$, and $O_4$ ignore the base packet. The object $O_1$ calculates the distance between the object $O_1$ and the base as described above. Packets may be encoded according to a protocol, such as IEEE 802.15.4.

Figure 6:
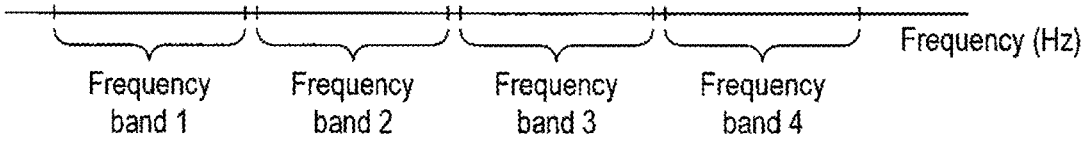
FIG. 6 shows an example of four non-overlapping frequency bands for the four objects shown in FIG. 5.

In another implementation, the objects may send signals to a base and receive signals from the base in different, non-overlapping frequency bands of the radio frequency spectrum. FIG. 6 shows an example of four non-overlapping frequency bands for the four objects shown in FIG. 5. Object $O_1$ transmits and receives signals from the base 502 in a frequency band 1. Object $O_2$ transmits and receives signals from the base 502 in a frequency band 2. Object $O_3$ transmits and receives signals from the base 502 in a frequency band 3. Object $O_4$ transmits and receives signals from the base 502 in a frequency band 4. Each object ignores signal that are not within the frequency band assigned to the object.

With reference to FIG. 2, the different radii used to define the zones may be used to set distance-based trigger levels which cause the system to perform different actions. These various distance-based trigger levels can correspond to different zones around the base, where the base serves as the home position for objects in communication with the base. For example, Zone 1 around the base 102 can be a "safe" zone. As long as the object 104 is located in Zone 1, no alarms are triggered. But, for example, if the object 104 enters Zone 2, then the object 104 emits a warning alarm sound, such as series of beeps or chirps, that indicate to a person holding the object 104 has entered a warning zone away from the base 102. If the object 104 enters Zone 3, then the object 104 emits a louder alarm sound that indicates to the person holding the object 104 the object 104 has entered an alarm zone away from the base 102. The object 104 remains in the alarm state while the distance d of the object 104 remains greater than the radius $r_2$.

The object 104 can remain in the alarming state until the object 104 is returned to the warning zone, whereupon the object 104 transitions to the warning state where the warning signal is produced. Furthermore, if the object 104 is carried into the safe zone, the object 104 can automatically transition to a safe state where no alarm signals are produced. The safe state, warning state, and alarm state of the object 104 may be displayed on a screen that enable a person holding the object 104 or connected to the object 104 to be aware of the location of the object 104 with respect to the base 102.

The wireless transceivers of the base 102 and the object 104 can send signals over a wireless network to a computer system. The computer system may be used to generate one or more additional alarms in a room when the object 104 is carried into the alarm zone. Suppose the object 104 is located in a room with a second alarm connected to a central computer system. Suppose a user carries the object 104 into the alarm zone. The object 104 may also send an alarm signal over a wireless network, such as wi-fi, to the computer system that triggers a second alarm in the room in addition to the alarm sounds emitted from the object 104. The computer system can also spatially track and log movements of the object 104 with respect to various distance thresholds and time stamp the locations of the object 104.

In another implementation. Zone 1 may be an alarm zone and Zone 3 may be a safe zone. The base 102 may be located near a door or an exit of a room or placed in a location within a room where a device, product, container, or person attached to the object 104 is not permitted.

Figure 7:
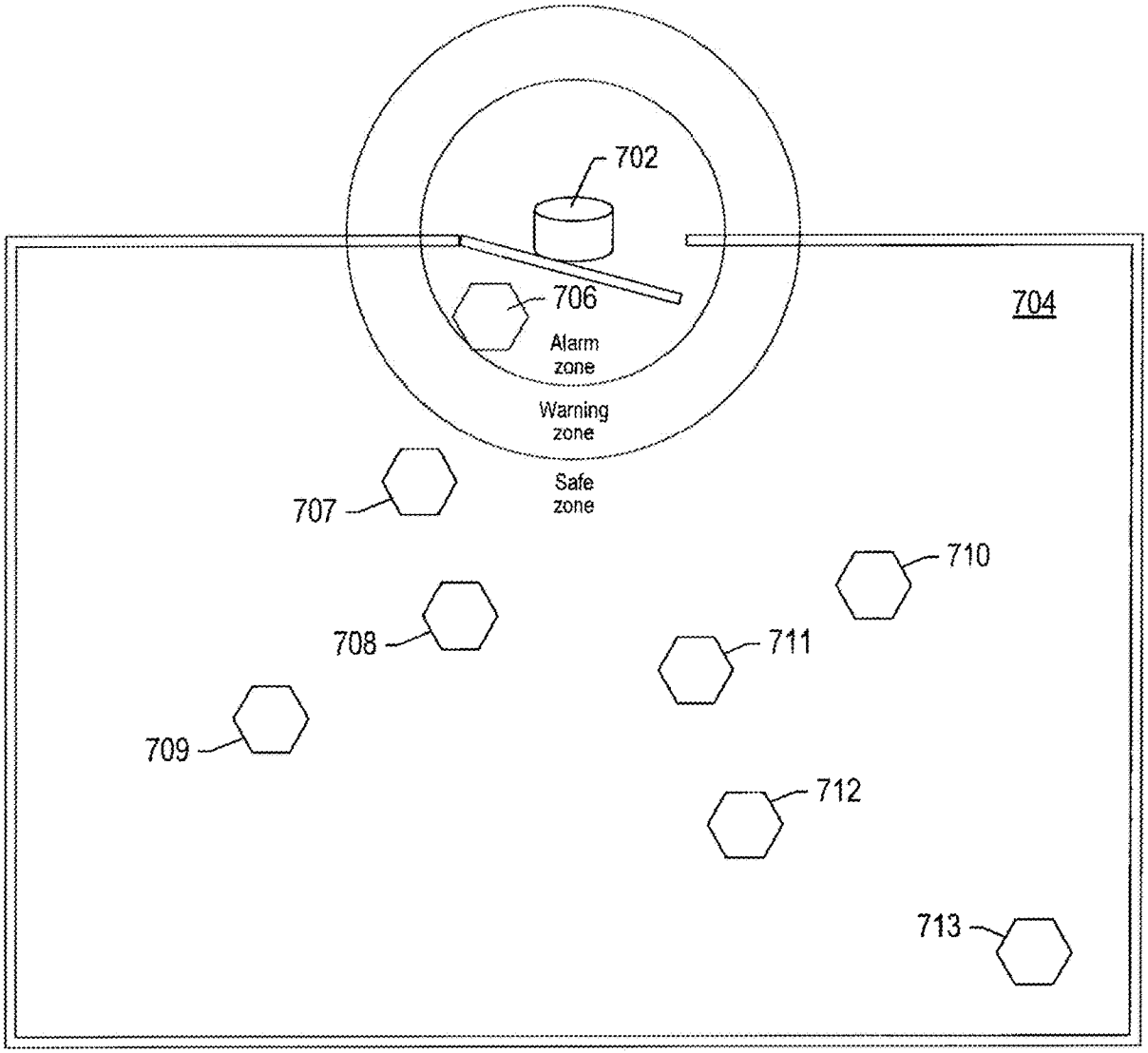
FIG. 7 shows an example of a base located near a door of a room.

FIG. 7 shows an example of a base 702 located near or above a door of a room 704. The room contains eight objects 706-713. The room 704 may be a retail store and the objects 706-713 may be attached to products, such as electronic devices, that are on display for customers to touch and examine. The room 704 may be a lab and the objects 706-713 may be attached to items or containers that are not permitted to leave the room 704. The room 704 may be a hospital ward and the objects 706-713 may be attached to beds, equipment or patients that are not permitted to leave the room. Each object determines the distance of the object to the base 702 as described above with reference to FIG. 3 or 4. In this example, the zones surrounding the base 702 as described above with reference to FIG. 2 have been defined so that Zone 3 is an alarm zone, Zone 2 remains a warning zone, and Zone 3 is a safe zone. As long as the objects 706-713 are located in the safe zone, no alarms are triggered. If an object enters the warning zone, the object emits a warning alarm sound as described above, indicating to a person holding the object the object has entered a warning zone with respect to the base 102. If an object enters the alarm zone, then the object emits a louder alarm sound that indicates to a person holding the object the object has entered the alarm zone. In the example of FIG. 7, the object 706 has entered the alarm zone, which triggers an alarm emitted from the object 706.

The locations of two or more objects may be spatially tracked in a space, such as room or a floor of a building, using three or more bases distributed about the space. For example, in a retail store, one of the bases can be placed at a display table 1 while another base can be linked to a checkout register. Three or more bases at spaced out locations in a space can facilitate planogram compliance monitoring as well as efficiently finding misplaced objects.

FIGS. 8A-8D show an example of spatially tracking an object 806 using five bases 801-805. The example described below with reference to FIGS. 8A-8D provide for tracking the coordinate locations of multiple objects on a virtual grid that maps to real-world coordinate locations in the space. In other words, the virtual coordinate location of each object on the virtual grid can be mapped to a real coordinate location in the space. The virtual grid can be used to determine the location of an object, such as an object attached to an item or a product, and determine which zone the object is located in and an alarm state (i.e., safe, warning, alarm) of the object.

Figure 8A:
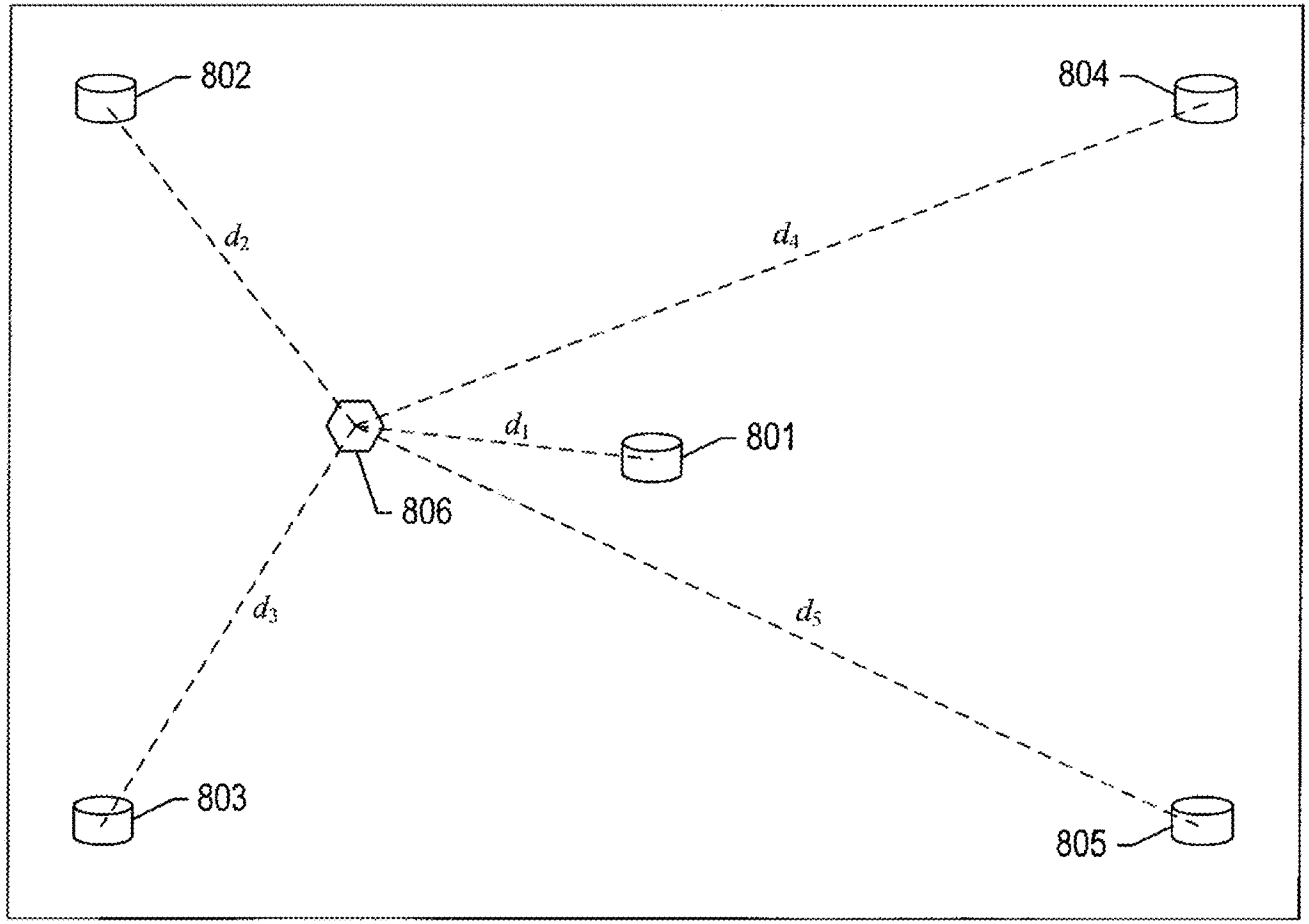
FIGS. 8A-8D show an example of spatially tracking an object using five bases.

FIG. 8A show a plan view of an example rectangular room 800 with the five bases 801-805. In this example, four bases 802-805 are located near the corners of the room 800 and base 801 is located in the center of the room 800. Object 806 is located in the room 800 and communicates separately with each of the bases 801-805 to separately determine the object's distance to each of the bases as described above with reference to FIG. 3 or 4. The room 800 may be a retail space for displaying products to customers and the object 806 may be attached to a product, such as electronic device on display. The room 800 may be a lab and the object 806 may be attached to equipment or containers. The room 800 may be a hospital ward and the object 806 may be attached to a bed, equipment, or a patient. The object 806 separately determines the distance to each of the bases 801-805 as describe above with reference to FIGS. 3-6. The distances are represented by dashed lines connecting the object 806 to each of the bases 801-805 and are denoted by $d_1$, $d_2$, $d_3$, $d_4$, and $d_5$. For example, the object 806 may determine the distance from itself to each of the bases every two seconds, every three seconds, or every four or more seconds.

Figure 8B:
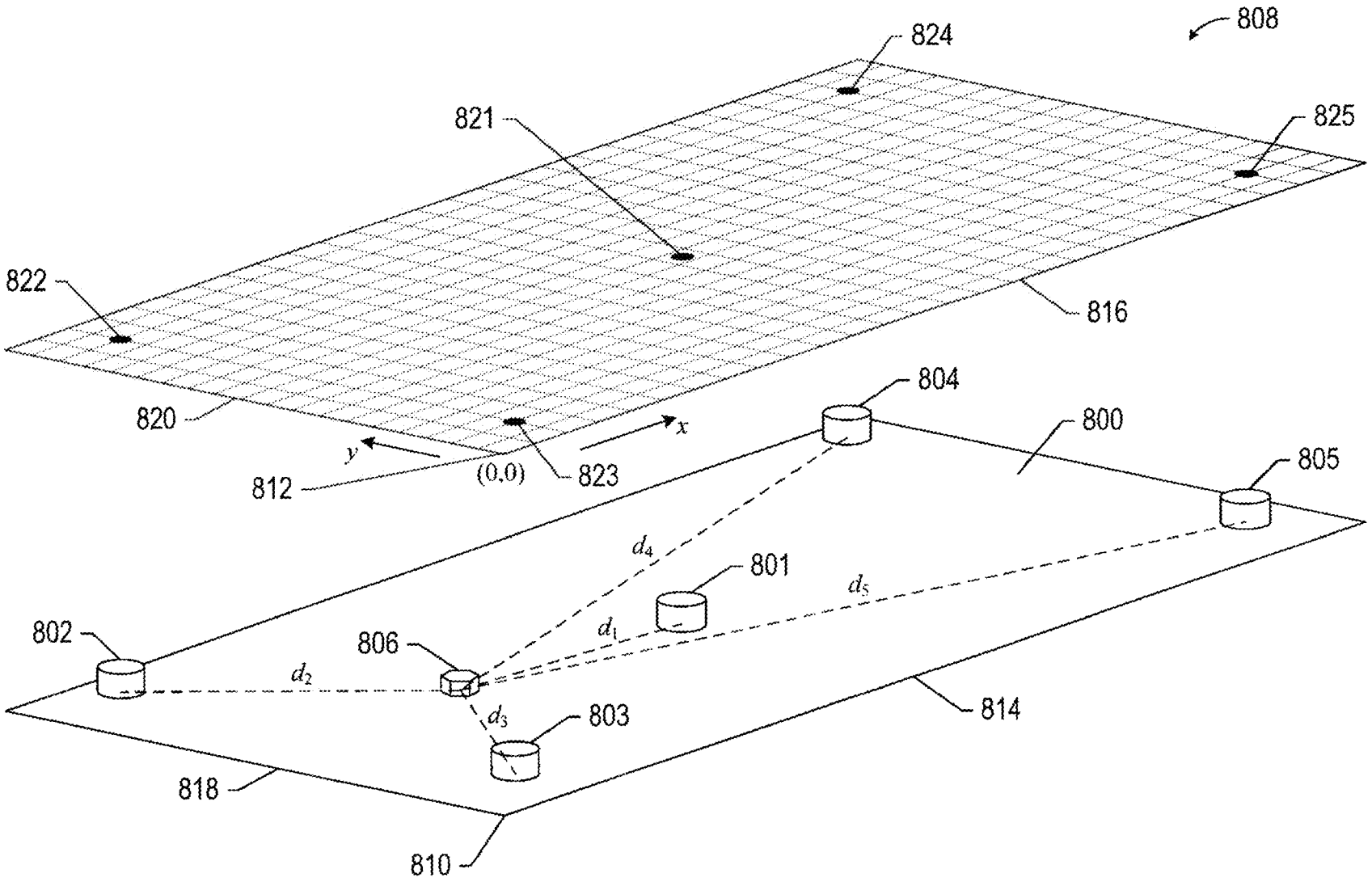

The room 800 dimensions and locations of the bases 801-805 are mapped to locations in a virtual grid 808 shown in FIG. 8B. In this example, corner 810 of the room 800 maps to the origin 812 of the virtual grid 808, wall 814 corresponds to the x-coordinate axis 816 in the virtual grid 808, and wall 818 corresponds to the y-coordinate axis 820 in the virtual grid 808. The bases 801-805 map to points 821-825 in the virtual grid 808.

Figure 8C:
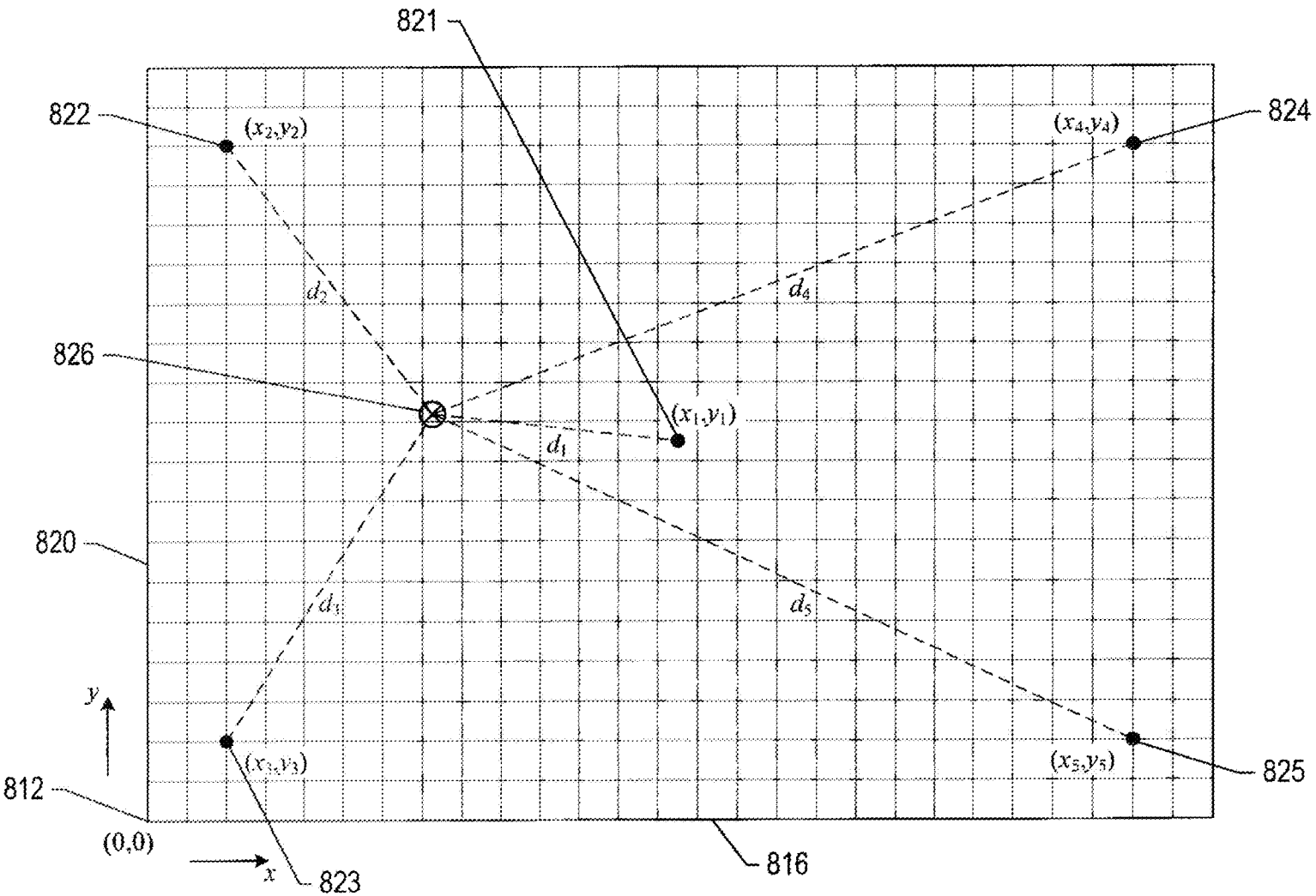

FIG. 8C shows a plan view of the virtual grid 808 with coordinate locations of the virtual grid 808 assigned to the points 821-825. Circle 826 represents the object 806. The object 806 stores the virtual grid 808 in memory or storage. However, the coordinate location of the object 806 in the virtual grid 808 is unknown. The object 806 determines the coordinate location of the object 806 in the virtual grid 806 based on the distances of the object 806 to any three of the bases 801-805 and the corresponding coordinate locations of the three bases. For example, suppose the object 806 is programmed to rank order the distances from shortest to farthest and select the three shortest distances. In this example, as shown in FIG. 3C, the three shortest distances are $d_1$, $d_2$, $d_3$, which correspond to the bases 801-803. The coordinate locations of the three closest bases 801-803 are $(x_1, y_1)$, $(x_2, y_2)$, and $(x_3, y_4)$. For example, the object 806 may compute the virtual coordinate location of the object 806 in the virtual grid 808 as follows:

$$x_o = \frac{(y_2 - y_3)A - (y_2 - y_1)B}{2[(x_2 - x_1)(y_2 - y_3) - (y_2 - y_1)(x_2 - x_3)]} \tag{1A}$$

$$y_o = \frac{(x_2 - x_1)B - (x_2 - x_3)A}{2[(x_2 - x_1)(y_2 - y_3) - (y_2 - y_1)(x_2 - x_3)]} \tag{1B}$$

where $$A = d_1^2 - d_2^2 - x_1^2 + x_2^2 - y_1^2 + y_2^2$$

$$B = d_3^2 - d_2^2 + x_2^2 - x_3^2 + y_2^2 - y_3^2$$

The virtual coordinate location $(x_0, y_0)$ of the object in the planar virtual grid 808 can then be scaled to match the real coordinate location in the room 800 by $(x_R, y_R) = (t + fx_0, t' + fy_0)$, where f is a scale factor that adjusts the units of the virtual coordinate location to units of the room 808 and t and t' are translations, enabling a use to identify the real coordinate location of the object in the room 808. In the example of FIG. 8B, the corner 810 in FIG. 8B may be used as the origin of the real coordinate system of the room 800, which corresponds to the origin 812 of the virtual grid 808. In this example, the translations t and t' are zero.

Equations (1A) and (1B) give a two-dimensional virtual coordinate location ($x_0$, $y_0$) of the object based on the assumption that the three or more bases and the object are located in the same horizontal plane, which in most cases may be accurate to within a foot. Other techniques, such as triangulation may be used to compute the virtual coordinate location. The virtual coordinate location may also be to determine a three-dimensional coordinate ($x_0$, $y_0$, $z_0$) for the object. For example, angle of transmission/reception techniques for wireless messages may be used to determine the distance between an object and a base. When angles are used rather than TOF, triangulation can be used to determine the virtual coordinates of the object. For example, Bluetooth specifications that employ angles of arrival and angles of departure to determine location may be used. Once the virtual coordinates for an object are determined, the virtual coordinates can be scaled to match the real coordinates of the room.

With the use of three or more bases to determine the coordinate location of an object in a space, virtual zones may be created in the virtual grid, each virtual zone corresponding to a zone in space where an object is permitted, not permitted, tolerated, or a zone where a function is performed. For example, relative zones, such as safe, warning, and alarm zones, can be formed during setup that can be used for triggering different actions. For example, with this relative mapping of zones, an object can have a safe "home" zone that is defined as the location where the object should be located. Once the object has marked a safe home zone on the virtual grid stored in the object, the object may be moved around the space and the object determines which zone the object is in and triggers appropriate warning/alarming sounds. In other words, the object is not limited to a pure distance/radius from a base as described above with reference to FIG. 2. As a result, zones can be more geometrically complex shapes such as polygon shapes because the coordinate location of the object can be determined with a high degree of accuracy using the method described above with reference to FIG. 8C. For example, when RF TOF is used to determine distances from the bases, the accuracy of the coordinate location can be determined within a foot of the actual location of the object.

Figure 8D:
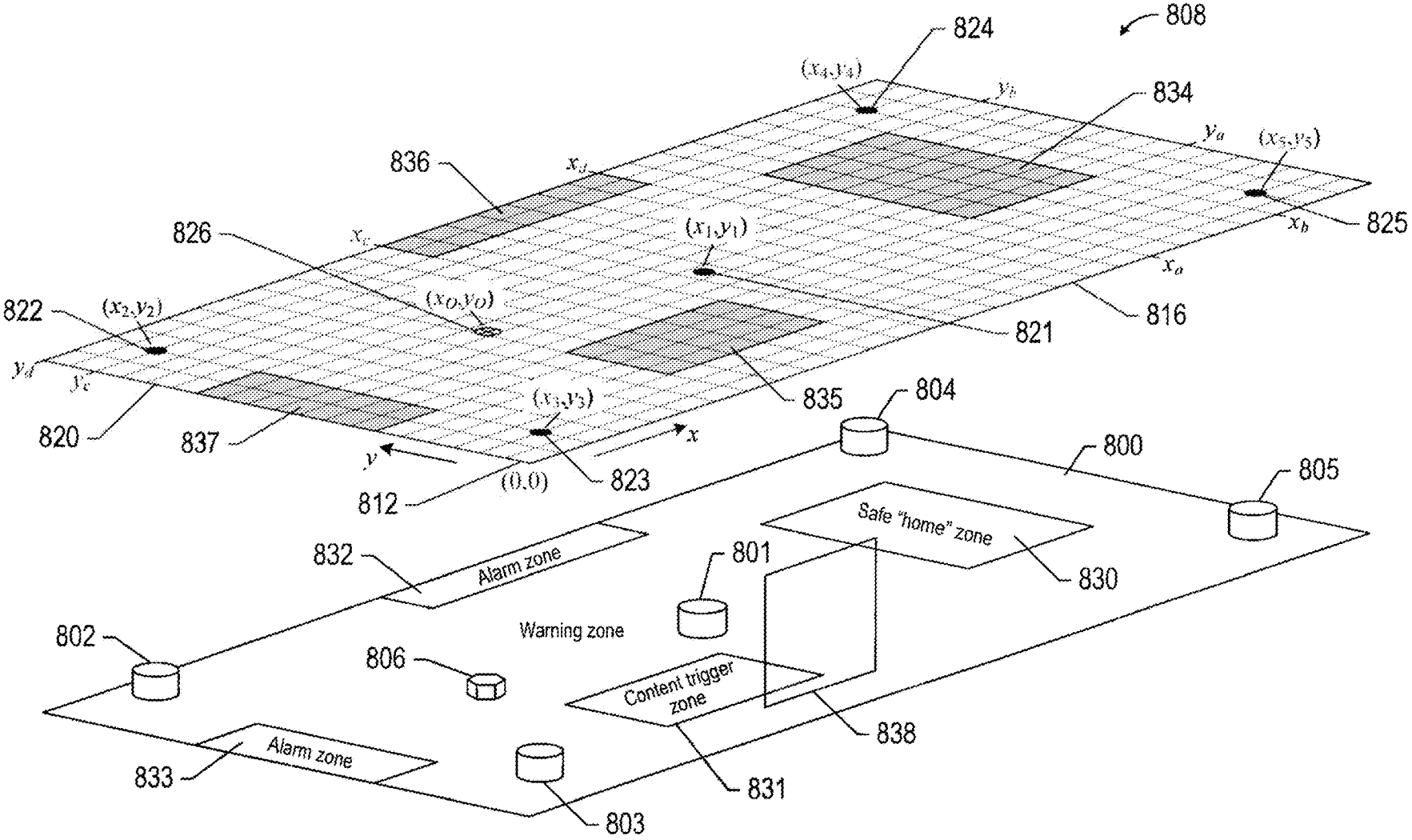

FIG. 8D shows an example of the room 800 partitioned into zone 830-833. Zones 830 and 831 are safe zones where the object 806 is permitted and an alarm will not be triggered provided the object 806 remains in the zones 830 and 831. Zones 832 and 833 are identified as alarm zones. The area of the room 800 that does not include the zones 830-833 is itself a warning zone. For example, the room 800 may be a display area of a retail store. Display tables may be located in the safe zones 830 and 831. Zones 832 and 833 are alarm zones located in front of doors leading in and out of the room 800. The zones 830-833 map to virtual areas 834-837 of the virtual grid 800. Each virtual area is defined by limits. For example, the virtual area 834 is defined by the limits $x_a \le x \le x_b$ and $y_a \le y \le y_b$ and the virtual area 836 is defined by the limits $x_c \le x \le x_d$ and $y_c \le y \le y_d$. After the object 806 determines the virtual coordinate location, ($x_O$, $y_O$), of the object 806, the object 806 may check each of the virtual zones to determine which zone the object 806 is located in. For example, if the object 806 has been moved to the alarm zone 832, then the virtual coordinate location satisfies the conditions $x_c \le x_O \le x_d$ and $y_c \le y_O \le y_d$ and the object 806 generates an alarm sound. If the product attached to the object 806 is an electronic device, the object 806 may send a signal to the electronic device that cause the electronic device to shut down (i.e., "brick" itself), rendering the electronic device inoperable. If the virtual object has been moved to the safe "home" zone 830, then the virtual object satisfies the conditions $x_a \le x_O \le x_b$ and $y_a \le y_O \le y_b$ and no alarm sounds are generated. If the object 806 is not located in any of the zones 830-833, the object 806 is located in the warning zone and a warning alarm sound is generated. When the object is located in the content trigger zone 831, which is also a safe zone, the object 806 may emit a signal over a wireless network that signals to a central computer system to display information about the product attached to the object 806 on a display screen 838, enabling the person holding the electronic device to view content about the device. Alternatively, when the object 806 is located in the content trigger zone 831, the object 806 may send a signal to the product, such as an electronic device, attached to the object 806 to display information about the product itself.

For the sake of simplicity, methods and systems for determining the coordinate location of an object have been described, but methods described above are performed for each of numerous objects located in the same space. Each object in the space performs the same operations described above to determine the object's virtual coordinate location and determine which zone the object is located in and generate an appropriate response. Each object has a virtual coordinate location that will tend to increase in fidelity resolution as more bases are added to the space. The various bases are widely spaced throughout the space so that each object can be spatially tracked using any of three nearby bases.

After each object in a space has determined their virtual coordinate location, the object can send a signal encoding the virtual coordinate location to a computer system, such as over a Wi-Fi network. The computer system maintains the same virtual grid as the objects, records the virtual coordinate location of each object, the corresponding real coordinate locations in the space, and tracks the virtual and real coordinate locations of the objects over time. The computer system can generate a graphical user interface ("GUI") that displays a map of the space based on the virtual grid. The GUI enables a user in real time to visually track the location of each object, zones of the space, and information regarding the alarm state of each object. The GUI may be displayed on a tablet computer screen that enables a user to walk around the room and visually verify the physical location of each object against the map of the room and virtual objects displayed in the GUI.

Figure 9A:
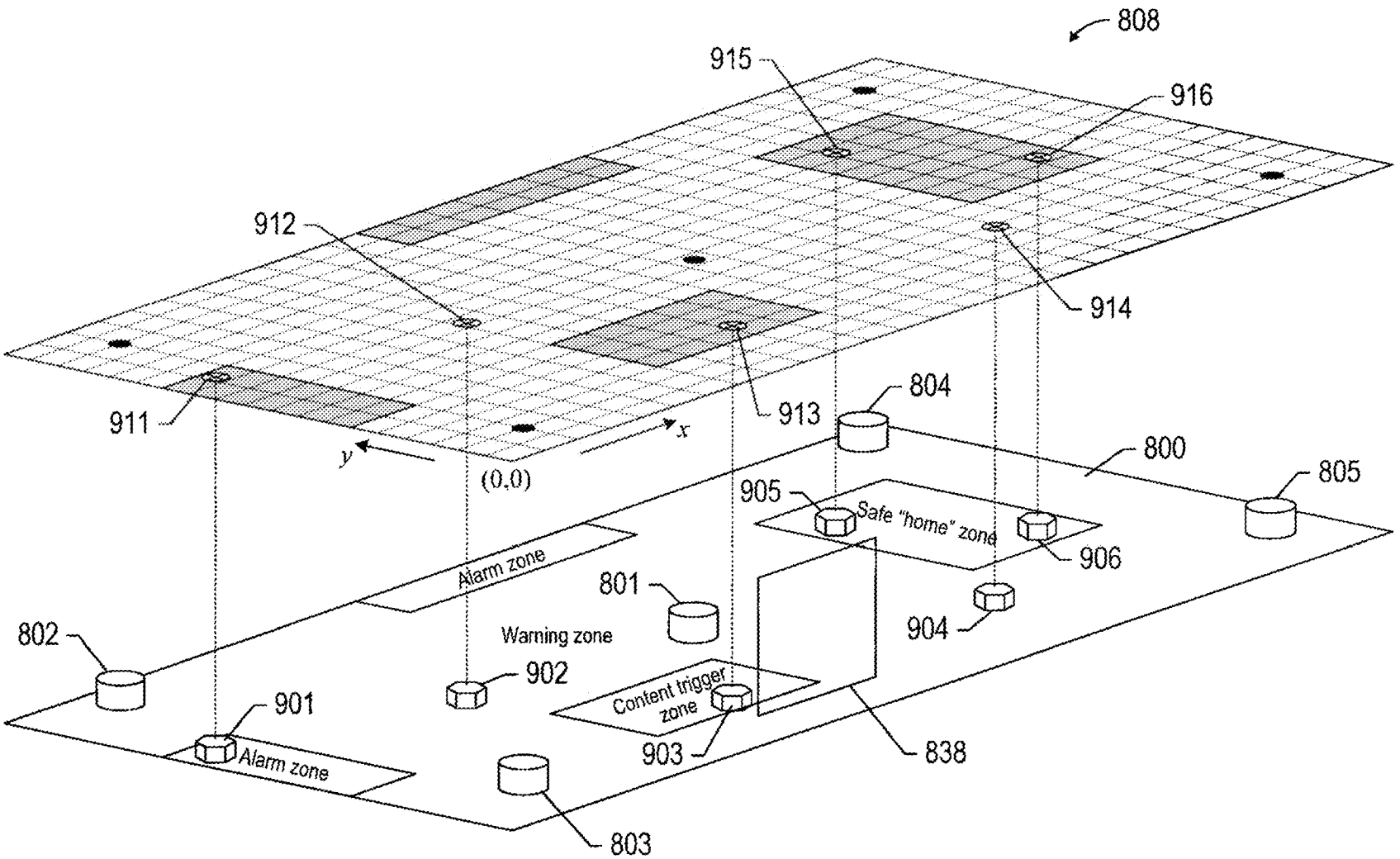
FIG. 9A shows an example of six objects at different locations in a room.

FIG. 9A shows an example of six objects 901-905 at different locations in the room 800. Each of the objects 901-905 maintains and stores the same virtual grid 808 and has determined its virtual coordinate location in the virtual grid 808 as described above with reference to FIGS. 8A-8D. A computer system receives the virtual coordinate locations of each of the objects 901-905. Points 911-915 are the virtual coordinate locations in the virtual grid 808. The virtual coordinate locations 911-915 can be used to track the locations of the corresponding objects 901-905 in within the room 800 and trigger appropriate responses as described above with reference to FIG. 8D.

Figure 9B:
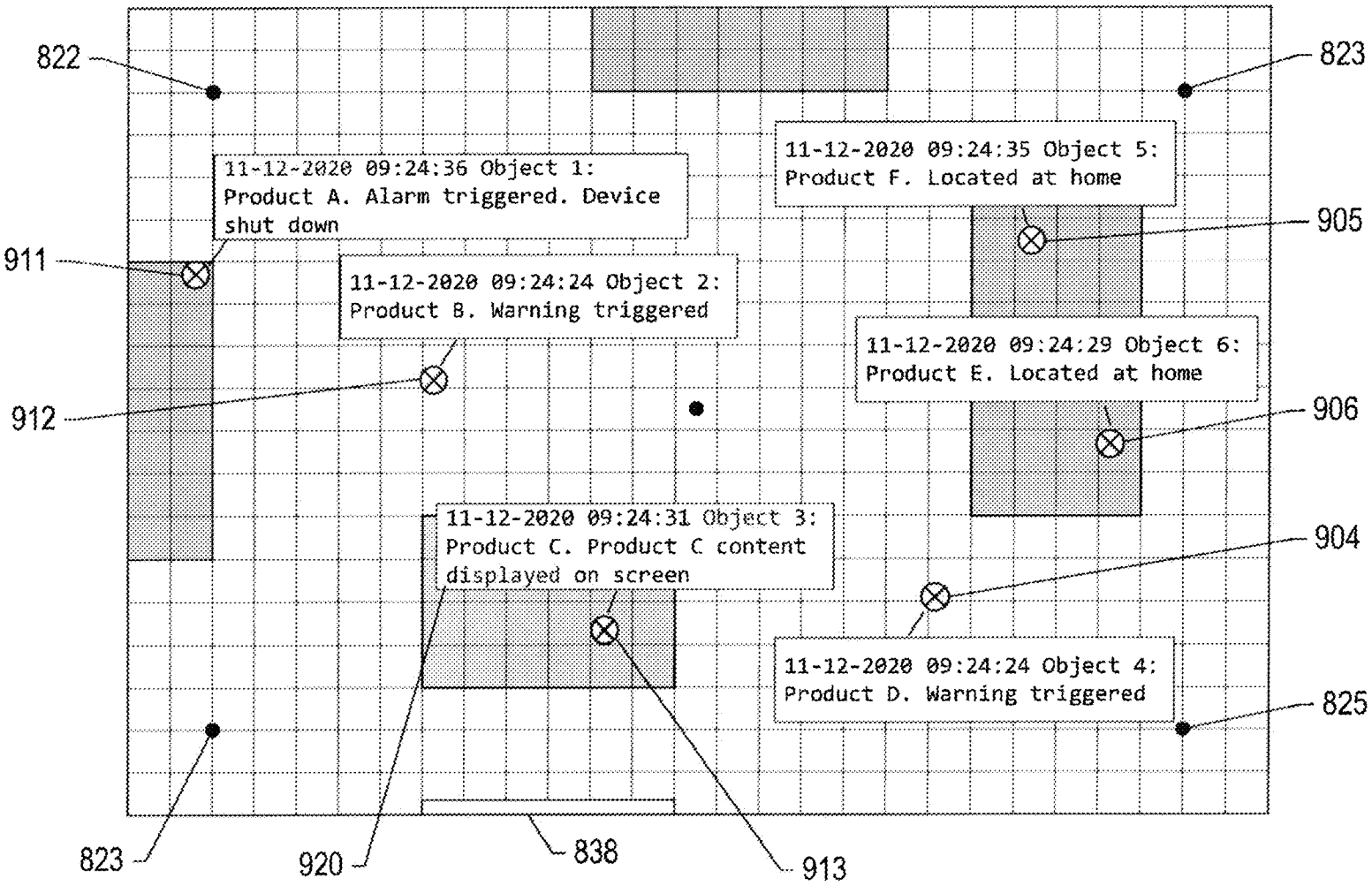
FIG. 9B shows an example graphical-user interface that displays a map of a room, zones in the room, and points that represent virtual coordinates of corresponding objects in the room shown in FIG. 9A.

FIG. 9B shows an example GUI of a map of the room 800, zones 834-837 that correspond to zones in the room 800, and points 911-915 that represent the virtual coordinates of the corresponding objects 901-905 shown in FIG. 9A. The GUI shows where the virtual coordinate locations of the spatially tracked objects are located within the room 800. Each object also includes a tag that identifies the object, the product attached to the object, date and time of the latest update to the location of the object, and the latest alarm state of the object. For example, tag 920 identifies the date and time when the object 903 identified as "Object 3" last determined its virtual coordinate location 913, displays information about the product "Product C" attached to the object, such as brand name and model number of the product, and explains that content about Product C is displayed on the screen 838, because the object 901 is located in the content trigger zone 831.

Electronic devices displayed in a retail setting are often displayed using a product display assembly. Methods and systems described above may be implemented in untethered product display assemblies.

Figure 10A:
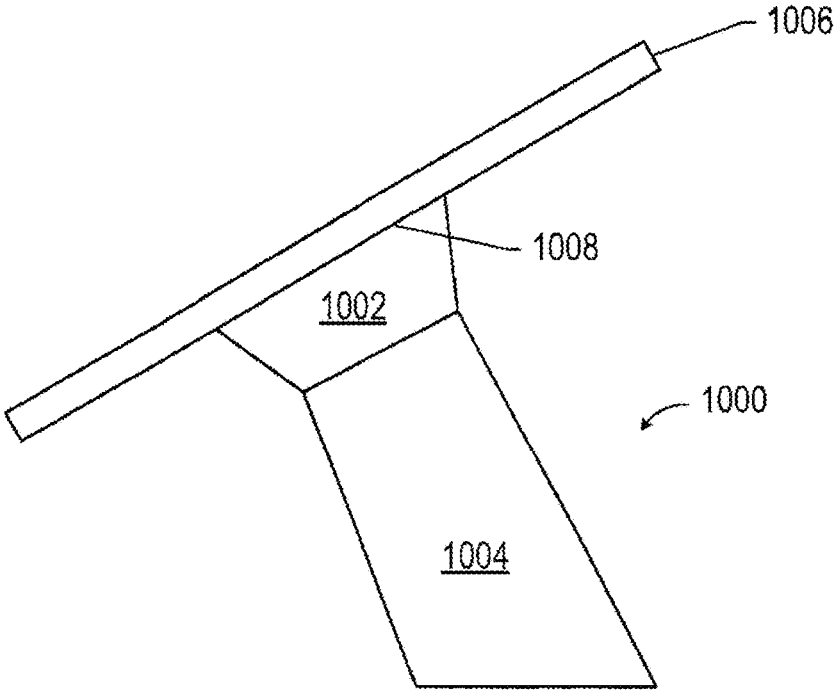
FIGS. 10A-10B show an example of an untethered product display assembly used to display a product.
Figure 10B:
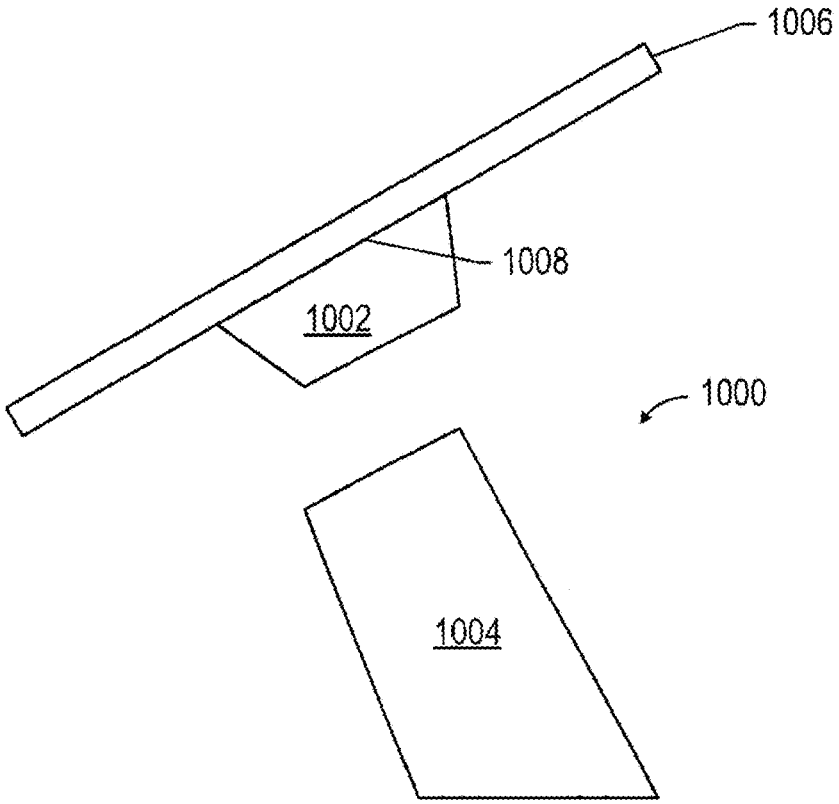

FIGS. 10A-10B show an example of an untethered product display assembly used to display a product, such as a cell phone, tablet, camera, or a wearable electronic device (e.g., smart watch). FIGS. 10A-10B shows an example embodiment of a product display assembly 1000 that includes a puck assembly 1002 and a base assembly 1004. The base assembly 1004 may be fixed to a surface, such as a display table, in a retail store. An electronic device 1006 can be mounted on a top or upper surface 1008 of the puck assembly 1002 so that the product can be securely displayed to customers in a store. The puck assembly 1002 is moveable between a rest position as shown in FIG. 10A and a lift position as shown in FIG. 10B. When the product 1006 is in the rest position shown in FIG. 10A, the puck assembly 1002 contacts the base assembly 1004. In this position, batteries within the puck assembly 1002 and the product can be recharged. When the product 1006 is in the lift position, the puck assembly 1002 is separated from the base assembly 1004, as shown in FIG. 10B. FIG. 10B shows how the puck assembly 1002 is not connected to the base assembly 104 via tether or have another anchor. The puck assembly 1002 can include the same electronics and be programmed to perform the same methods as the objects describe above with reference to FIGS. 1-9B. In other words, the objects described above can be puck assemblies of product display assemblies. The puck assembly 1002 can be used to determine the virtual and real coordinate locations of the product 1006 in the same manner described above. In this fashion, customers are not only able to pick up, hold, and inspect the product 1006 attached to the puck assembly 1002 when making a purchase decision, but customers can also freely step back from the base assembly 1004 while the puck assembly 1002 is in the lift position without the product being pulled under high tension of a retractable tether assembly.

The puck assembly 1002 may include a motion sensor, such as an accelerometer, that detects translational motion and orientation of the puck assembly 102. When the puck assembly 1002 is located in a content trigger zone, as described above with reference to FIGS. 8D and 9A, and the puck assembly 1002 has been lifted from the base assembly 1004 content displayed on a display screen may be changed in response to detecting the puck assembly 1002 in a content trigger zone and/or detecting that the puck assembly 1002 has been lifted from the base assembly 1004. In an alternative implementation, the content trigger zone may be omitted. When the puck assembly 1002 has been lifted from the base assembly 1004 content displayed on a display screen may be changed in response to detecting movement of the puck assembly 1002.

Figure 11A:
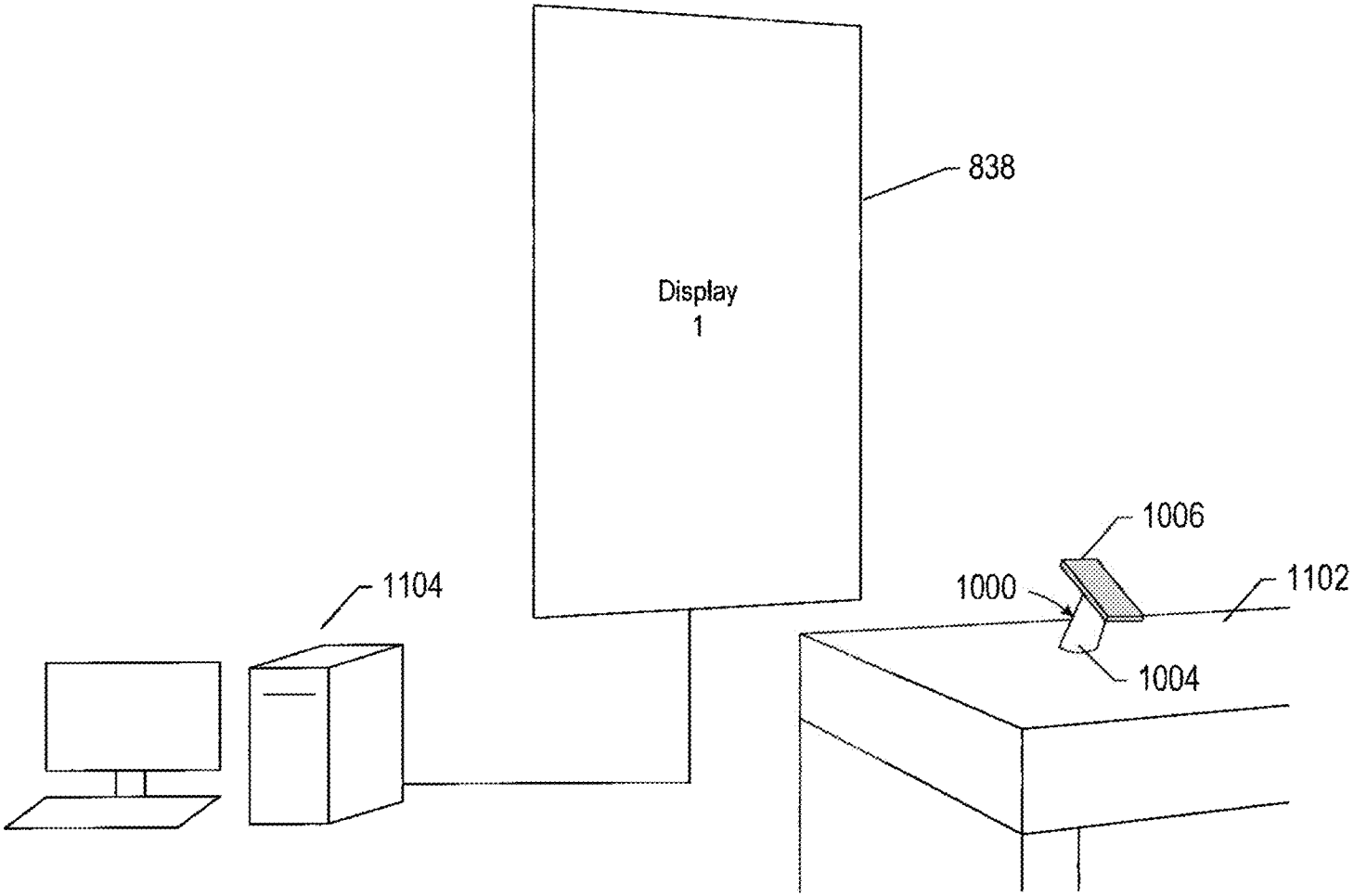
FIGS. 11A-11E show an example of a moving puck assembly that controls display of content on a screen.

FIGS. 11A-11E show an example moving puck assembly that controls the display of content on a screen. The product display assembly 1000 and product 1006 are located on a display table 1102. The display table 1102 may be located in a content trigger zone, such as the content trigger zone 831. In FIG. 11A, the product 1006 is attached to a puck assembly 102 (not shown in FIG. 11A) and the puck assembly 102 is in a rest position seated on the base assembly 104. Screen 838 displays digital signage identified as "Display 1." For example, Display 1 may be a display of general content regarding the retail store, such as advertising regarding a variety of the electronic devices sold in the retail store.

Figure 11B:
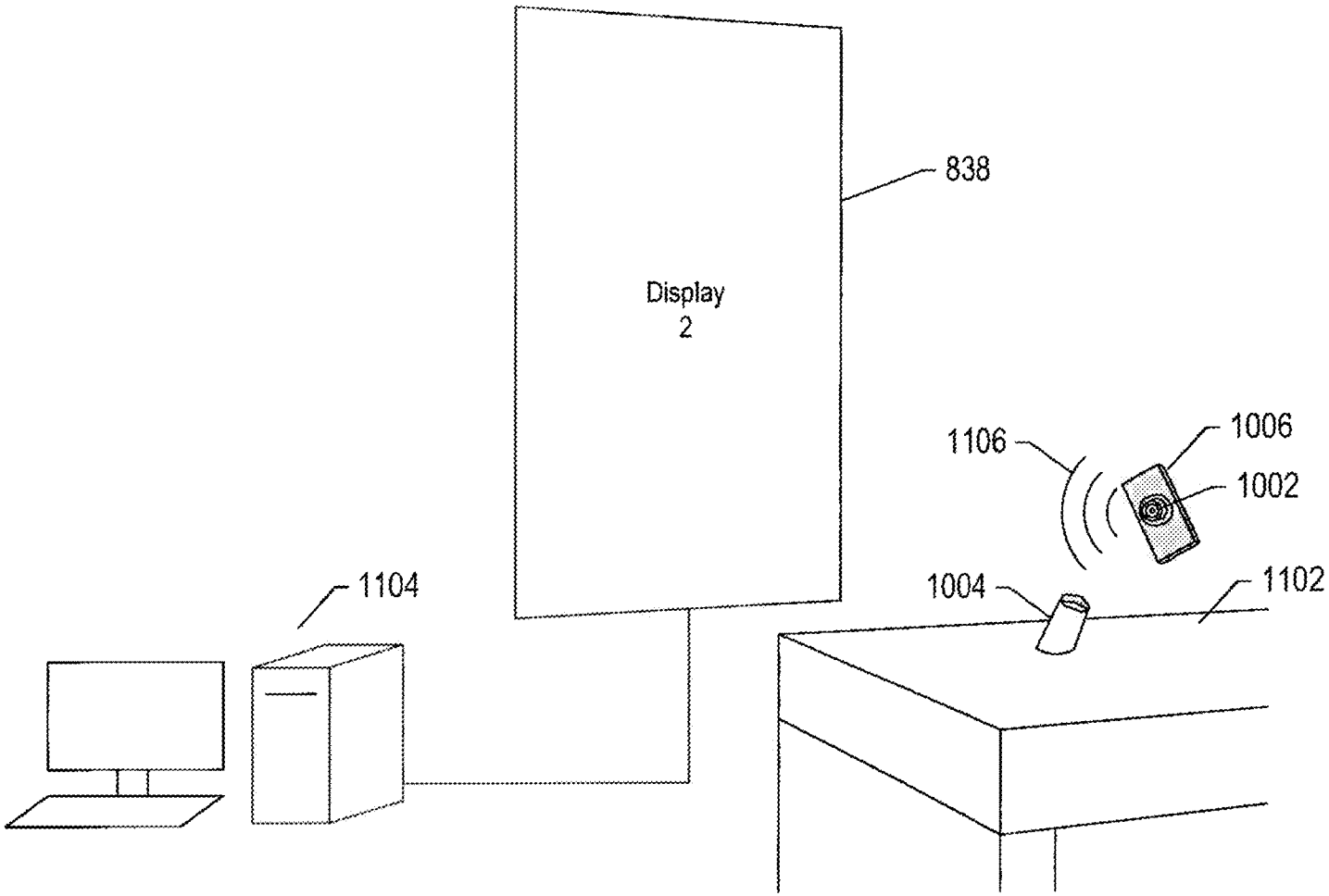

FIG. 11B shows the product 1006 and the attached puck assembly 1002 lifted from the base assembly 1004 by a customer (not shown). Because the puck assembly 1002 is located in the content trigger zone 831 and the motion sensor in the puck assembly 1002 has detected the lift, a wireless signal 1106 is sent from the puck assembly 1002 to the computer system 1104 which changes content of the screen 838 to "Display 2." Display 2 may be useful for the customer when inspecting the product 1006. For example, Display 2 may contain a description and illustration of features of the product 1006. The signal 1106 can be sent directly by the puck assembly 1002 or via the base assembly 1004.

Figure 11C:
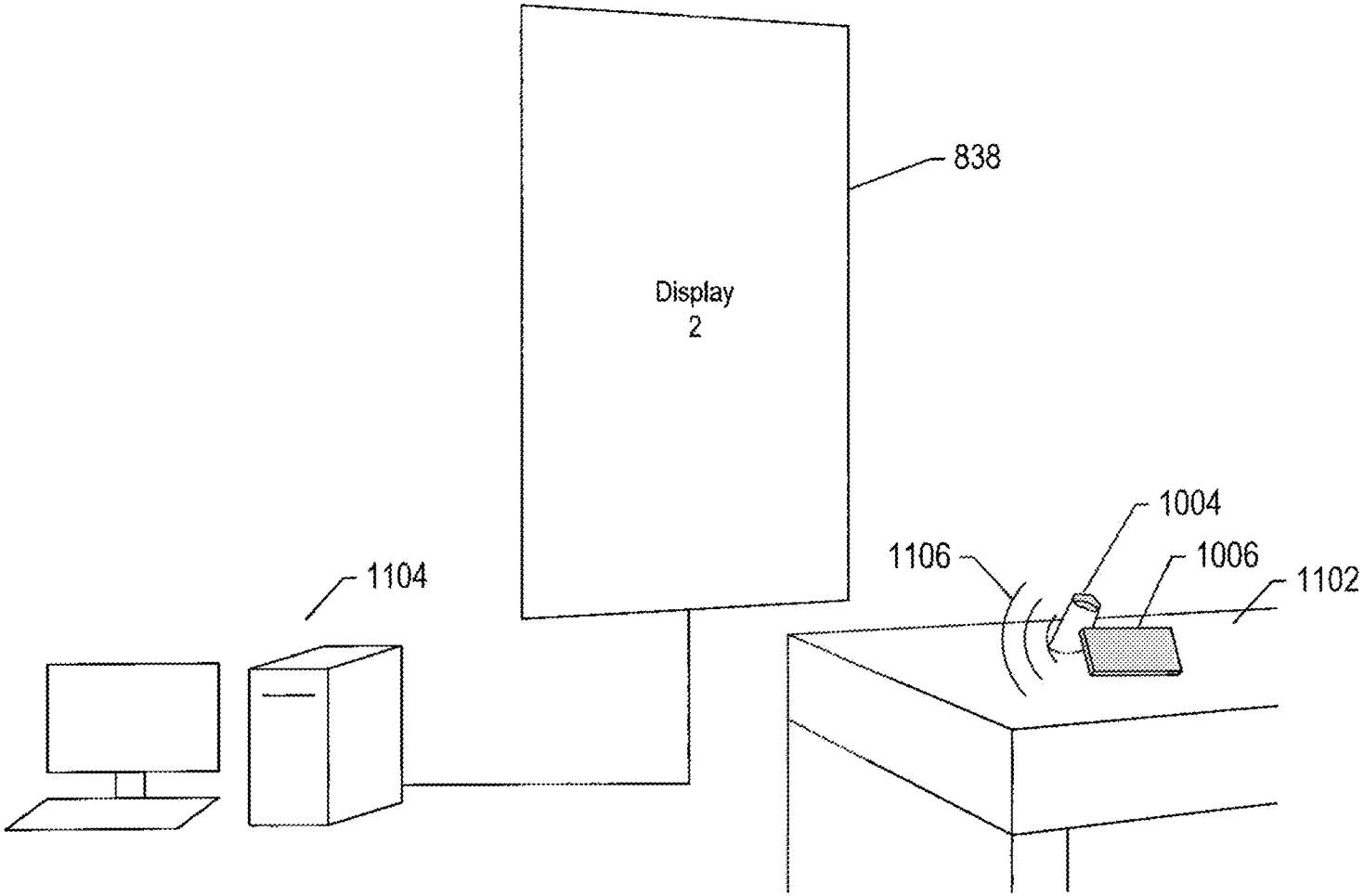
Figure 11D:
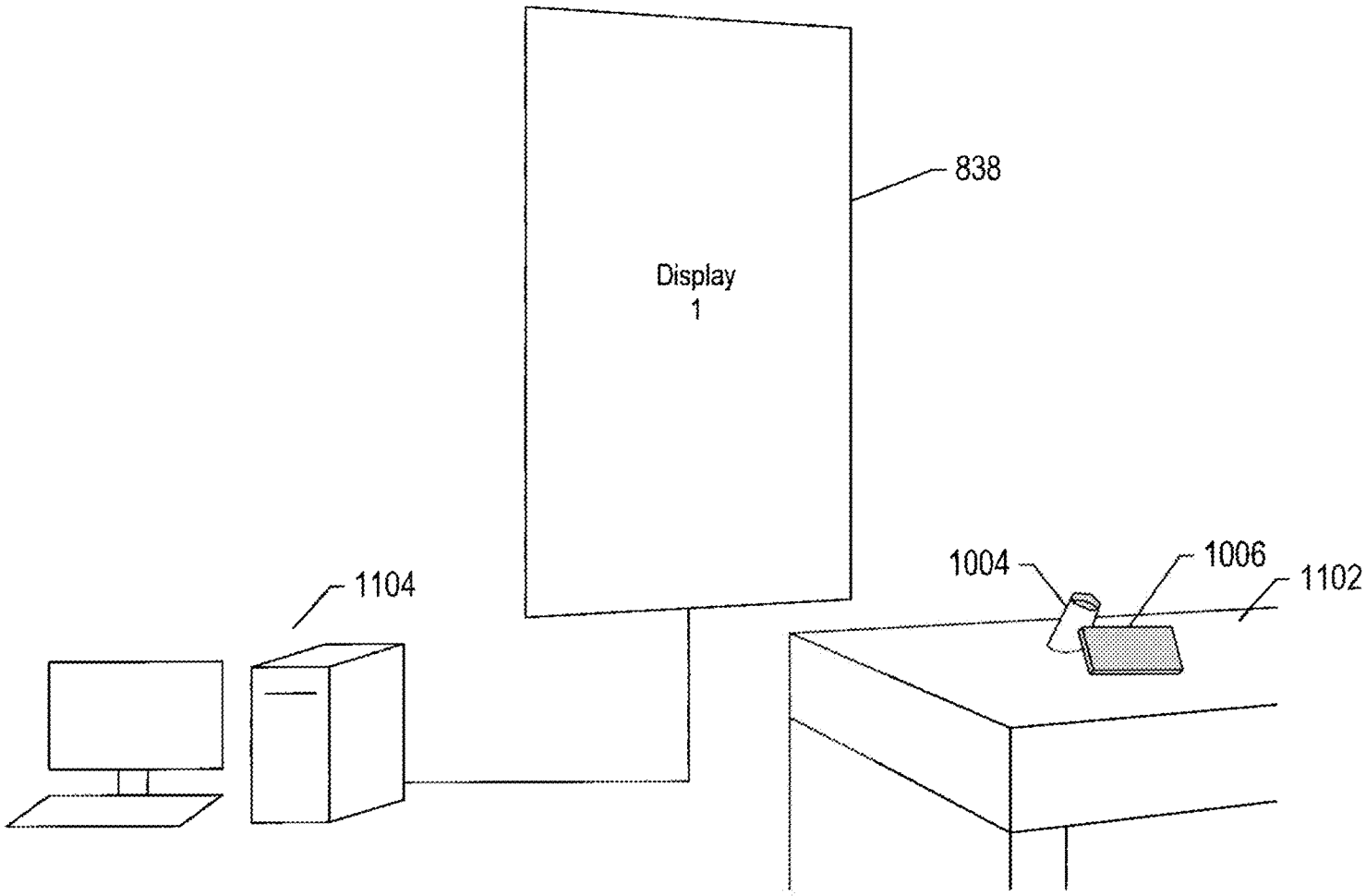

FIG. 11C shows the puck assembly 1002 and the attached product 1006 left on the display table 1102. The puck assembly 1002 is not seated in the rest position on the base assembly 1004. The puck assembly 1002 may continue to send signals 1106 for a brief period, such as a minute or five minutes, after the puck assembly 1002 is no longer moving. The processor of the puck assembly 1002 executes instructions that determine the puck assembly 1002 is no longer moving based on not receiving signals from the motion sensor. The puck assembly 1002 stops sending signals to the computer system 1104. As a result, the computer system 1104 returns the screen 838 to display Display 1 as shown in FIG. 7D.

Figure 11E:
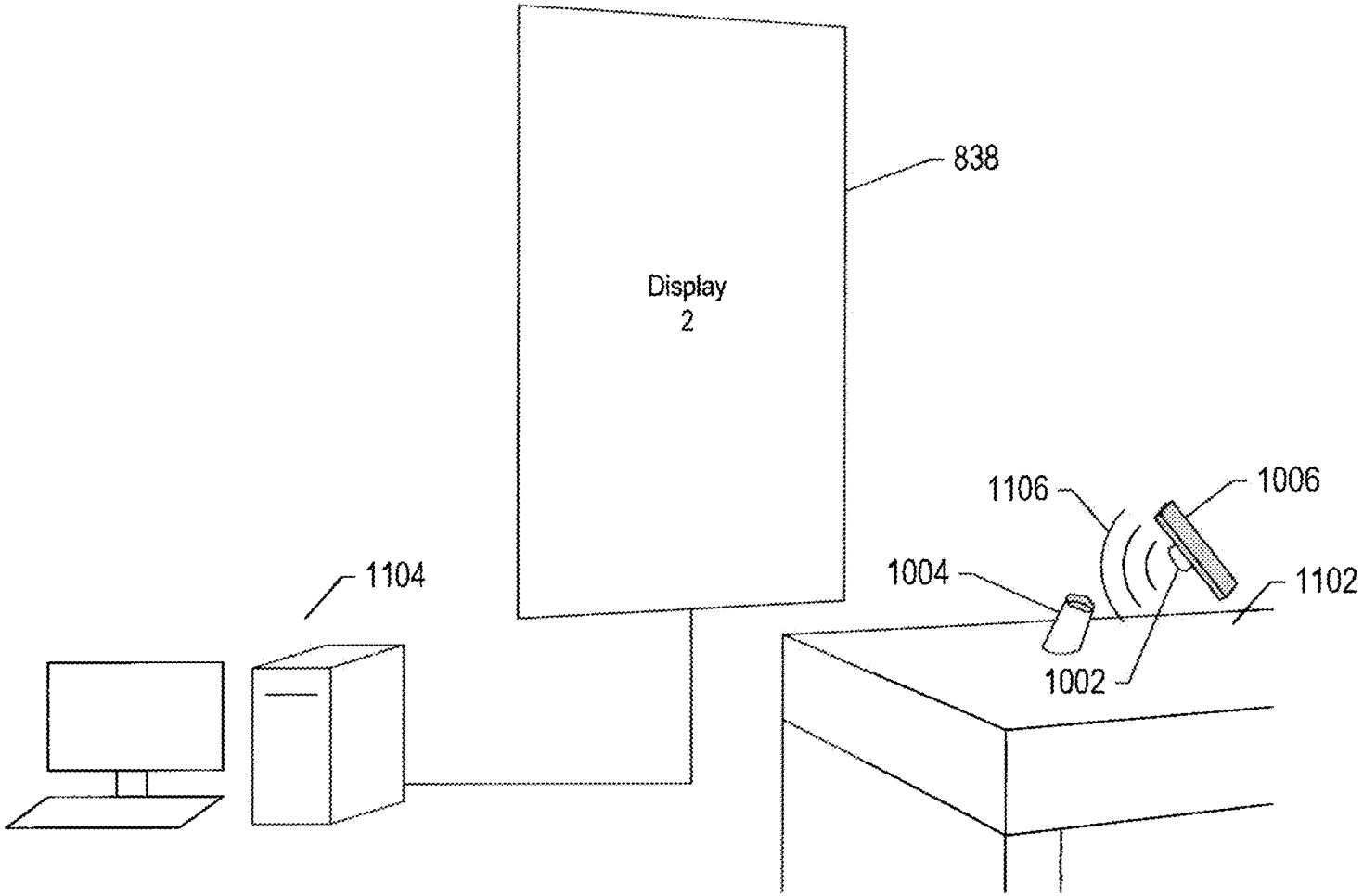

When another customer lifts the puck assembly 1002 and the product 1006 from the display table 1102 as shown in FIG. 11E, the motion sensor in the puck assembly 1002 detects the motion and generates the signal 1106. The computer system 1104 then changes the screen 838 to display Display 2.

Note that puck assembly 1002 is not limited to having to be in a content trigger zone to change the display on the screen 838. In another implementation, the display table 1102 and product display assembly 1000 may not be located in a content trigger zone. Movement of the puck assembly 1002 alone without being in content trigger zone may be used to trigger the signal 1106, which results in a change in the display of the screen 838 as described above.

While various examples discussed herein describe how alarms can be produced when an object, such as the puck assembly 1002, moves inside or outside various zones, these alarms need not necessarily be audible alarms. Moreover, while in some examples the alarms can be generated by an alarm module located in the objects, it should be understood that the alarm modules may be located elsewhere in the system, such as within the bases or within standalone alarm modules. Moreover, the alarm modules may be capable of switching between an armed state and a disarmed state when commanded to do so by an authorized user. Thus, if the system is capable of disarming an alarm, there may be instances where the alarms are disarmed to authorize certain movements of the objects that would normally otherwise trigger an alarm signal.

It is appreciated that the above description of the disclosed embodiments is provided to enable any person skilled in the art to make or use the present disclosure. Various modifications to these embodiments will be apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A retail security system comprising:

three or more bases spatially distributed in a space, each base having a wireless transceiver; and a puck assembly having a surface on which a product is mountable for merchandising of the product to a customer and a wireless transceiver, and wherein the puck assembly is untethered and can be lifted and moved by customers to any location within the space, wherein the puck assembly determines a virtual coordinate location of the puck assembly in a virtual grid that maps to real coordinate locations in the space based on wireless communications between the puck assembly and the three or more bases, and wherein the puck assembly uses the virtual coordinate location and the virtual grid to determine whether the puck assembly is located in a permitted virtual zone or a not permitted virtual zone of the virtual grid and generate an alert when the puck assembly is located in the not permitted virtual zone.

2. The system of claim 1 wherein the virtual grid is stored in the puck assembly and virtual coordinate locations of the virtual grid map to coordinate locations in the space.

3. The system of claim 1 wherein the virtual coordinate location maps to a real coordinate location in the space.

4. The system of claim 1 wherein the puck assembly includes an alarm module that generates a warning sound in response to the virtual coordinate location being located in a warning zone of the virtual grid.

5. The system of claim 1 wherein the puck assembly includes an alarm module that generates an alarm sound in response to the virtual coordinate location being located in an alarm zone of the virtual grid.

6. The system of claim 1 further comprising a base assembly on which the puck assembly is restable, and wherein the base assembly includes one of the bases.

7. The system of claim 1 wherein the puck assembly determines the virtual coordinate location of the puck assembly in the space based on signal strength of signals sent from the three or more bases.

8. The system of claim 1 wherein the puck assembly determines the virtual coordinate location of the puck assembly in the space based on radio frequency time of flight for roundtrip wireless signals.

9. The system of claim 1 wherein the permitted virtual zone corresponds to a safe zone in the space and the not permitted virtual zone corresponds to one of a warning zone and an alarm zone in the space.

10. A retail security system comprising:

three or more bases spatially distributed in a space, each base having a wireless transceiver; and a puck assembly having a surface on which a product is mountable for merchandising of the product to a customer and including data storage, a processor, an alarm module, a wireless transceiver and machine-readable instructions stored on the data storage that when executed by the processor determines a virtual coordinate location of the puck assembly of a virtual grid that maps to real coordinate locations in the space based on the wireless communications between the puck assembly and the three or more bases, uses the virtual coordinate location and the virtual grid to determine a virtual zone of the virtual grid the puck assembly is located within, and generates an alarm sound using the alarm module in response to the virtual coordinate location being located in one of a virtual alarm zone and a virtual warning zone that correspond to an alarm zone and a warning zone of the space.

11. The system of claim 10 wherein puck assembly generates the alarm sound comprises automatically turning off the alarm sound when the puck assembly is moved from the virtual alarm zone or virtual the warning zone into a virtual safe zone that corresponds to a safe zone of the space.

12. The system of claim 10 comprises a base assembly on which the puck assembly is restable, wherein the base assembly includes one of the bases and serves as the home location for the puck assembly.

13. The system of claim 10 wherein the virtual grid is stored in the data storage of the puck assembly and virtual coordinate locations of the virtual grid map to coordinate locations in the space.

14. The system of claim 10 wherein the virtual coordinate location maps to a real coordinate location in the space.

15. The system of claim 10 wherein the puck assembly determines the virtual coordinate location of the puck assembly in the virtual grid based on signal strength of signals sent from the three or more bases.

16. The system of claim 10 wherein the puck assembly determines the virtual coordinate location of the puck assembly in the virtual grid based on radio frequency time of flight for roundtrip wireless signals.

17. A retail security system comprising:

a plurality of bases spatially distributed in a space, each base having a wireless transceiver; and a plurality of puck assemblies located in the space, each puck assembly having a surface on which a product is mountable for merchandising of the product to a customer and is untethered to a base assembly, each puck including data storage, a processor, an alarm module, a wireless transceiver, and machine-readable instructions stored on the data storage and that when executed by the processor determines a virtual coordinate location of the puck assembly of a virtual grid that maps to real coordinate locations in the space based on the wireless communications between the puck assembly and three of the plurality of bases, uses the virtual coordinate location and the virtual grid to determine a virtual zone of the virtual grid the puck assembly is located within, and generates an alarm sound using the alarm module in response to the virtual coordinate location being located in one of a virtual alarm zone and a virtual warning zone that correspond to an alarm zone and a warning zone of the space.

18. The system of claim 17 wherein each puck assembly generates the alarm sound comprises automatically turning off the alarm sound when the puck assembly is moved from the virtual alarm zone or the virtual warning zone into a virtual safe zone that corresponds to a safe zone of the space.

19. The system of claim 17 comprises a plurality of base assemblies, wherein each of the plurality of puck assembly is restable on one of the plurality of puck assembly, and wherein the base assemblies are the bases.

20. The system of claim 17 wherein each puck assembly determines the virtual coordinate location of the puck assembly in the virtual grid based on signal strength of signals sent from the three or more bases.

21. The system of claim 17 wherein each puck assembly determines the virtual coordinate location of the puck assembly in the virtual grid based on radio frequency time of flight for roundtrip wireless signals.

* * * * *